US008007598B2

(12) United States Patent
Chen et al.

(10) Patent No.: US 8,007,598 B2
(45) Date of Patent: Aug. 30, 2011

(54) DISHWASHER HAVING MULTIPLE SPRAY ZONES

(75) Inventors: David Hung-Chih Chen, Saint Joseph, MI (US); Brian Lee Greenhaw, Berrien Center, MI (US); Mark D. Kerber, Saint Joseph, MI (US); Carl A. Rotter, Paw Paw, MI (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 465 days.

(21) Appl. No.: 12/258,472

(22) Filed: Oct. 27, 2008

(65) Prior Publication Data

US 2010/0101611 A1 Apr. 29, 2010

(51) Int. Cl.
*B08B 3/02* (2006.01)

(52) U.S. Cl. ..... 134/56 D

(58) Field of Classification Search ..... 134/156 D
See application file for complete search history.

(56) References Cited

U.S. PATENT DOCUMENTS

| | | | | |
|---|---|---|---|---|
| 1,897,821 | A | 2/1933 | Poli | |
| 2,664,902 | A | 1/1954 | Campion | |
| 3,288,155 | A | 11/1966 | Swetnam | |
| 3,915,182 | A | 10/1975 | Payne | |
| 6,758,227 | B2 | 7/2004 | Lee et al. | |
| 2005/0022847 | A1 | 2/2005 | Nito et al. | |
| 2005/0133070 | A1 * | 6/2005 | Vanderroest et al. | 134/56 D |
| 2007/0006903 | A1 | 1/2007 | Koch et al. | |

FOREIGN PATENT DOCUMENTS

WO 2004/019747 A1 3/2004

* cited by examiner

*Primary Examiner* — Michael Kornakov
*Assistant Examiner* — Samuel A Waldbaum
(74) *Attorney, Agent, or Firm* — McGarry Bair PC; Robert A. Bacon

(57) ABSTRACT

A method and apparatus for providing multiple spray zones, including a localized spray zone for an upper rack and a silverware spray zone for a silverware basket, within the wash chamber of a dishwasher.

16 Claims, 8 Drawing Sheets

DISHWASHER HAVING MULTIPLE SPRAY ZONES

BACKGROUND OF THE INVENTION

Automatic dishwashers are commonly found in household environments. A typical automatic dishwasher comprises a cabinet that defines a wash chamber, which is accessible through a moveable door. An upper and a lower rack for holding utensils to be cleaned are provided within the wash chamber. A silverware basket for holding utensils, silverware, etc. is also usually provided and normally removably mounts to the door or within the lower rack. The silverware basket is configured to hold elongated utensils such as knives, spoons, forks, spatulas in a vertical orientation as well as smaller objects that might fall through racks.

Liquid is sprayed into the upper and lower racks and the silverware basket to clean any utensils they contain. Rotating spray arms arranged below each rack and spraying upwardly through the bottom of the corresponding rack delivers the liquid to the utensils. The liquid spray pattern is generally in the form of a circle when viewed in planform. The velocity of the liquid exiting the spray arm tends to drop off from the center of the spray arm to the ends of the spray arm.

The silverware basket tends to receive less liquid from the spray arms and tends to receive the lower velocity liquid because the silverware basket is located at the periphery of the spray pattern. The volume and velocity of the sprayed liquid reaching the silverware basket are further reduced in that the liquid must pass through the structure of the lower rack as well as the structure of the silverware basket. All of which leads to reduced cleaning performance for utensils in the basket relative to utensils in the lower rack.

SUMMARY OF THE INVENTION

The invention relates to an automatic dishwasher comprising a wash chamber, an upper rack having a bottom located within the wash chamber, a silverware basket located in the wash chamber beneath the upper rack, an upper spray arm rotatably mounted to the bottom of the upper rack and providing a liquid spray upwardly through the bottom of the upper rack to define a generalized spray zone for the entire upper rack, and an auxiliary sprayer carried by the upper rack and having a localized spray zone directed upwardly to a discrete portion of the upper rack and a silverware spray zone directed downwardly onto the silverware basket.

The invention further relates to a method for delivering liquid to a dishwasher by emitting a generalized spray of liquid upwardly through a bottom of a rack, simultaneously emitting a focused spray of liquid upwardly toward a discrete portion of the upper rack, and emitting a spray of liquid toward a silverware basket located beneath the rack.

DETAILED DESCRIPTION

Figure 1:
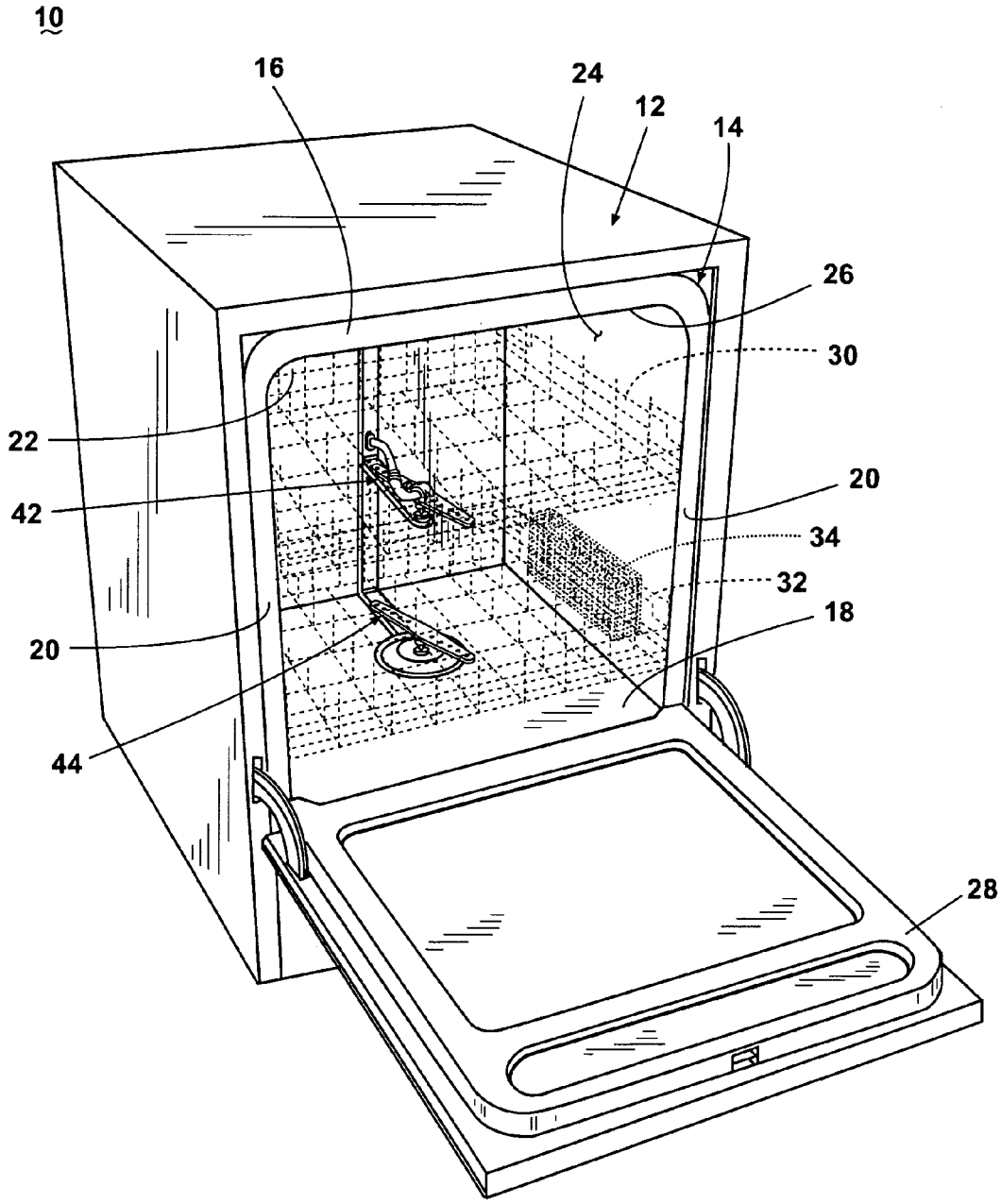
FIG. 1 is a perspective view of a first embodiment of an automatic dishwasher, with an auxiliary sprayer providing one or more dedicated spray zones in accordance with the invention.

FIG. 1 is a perspective view of an automatic dishwasher 10 in accordance with a first embodiment of the invention. As illustrated, the dishwasher 10 includes a housing 12 for enclosing a wash tub 14. The dishwasher 10 shares many features of a conventional automatic dishwasher, which will not be described in detail herein except as necessary for a complete understanding of the invention. The wash tub 14 has spaced top and bottom walls 16 and 18, spaced side walls 20, and a rear wall 22. The walls 16, 18, 20, and 22 join along their respective edges to define a wash chamber 24 with an access opening in the form of an open face 26. A door 28 is hingedly mounted to the housing 12 and can move between an opened position, as illustrated in FIG. 1, to provide access to the wash chamber 24 and a closed position (shown in FIG. 2) to close the wash chamber 24 by covering the open face 26 of the wash chamber 24. Typically, the door 28 is in the opened position when utensils are loaded or unloaded into the dishwasher 10 and in the closed position while the washing cycle is running or while the dishwasher 10 is not in use.

Utensil holders (shown in phantom in FIG. 1 for clarity of the surrounding structure) in the form of upper and lower racks 30, 32 are located within the wash chamber 24 and receive utensils for washing. The racks 30, 32 are typically mounted for slidable movement in and out of the wash chamber 24 for ease of loading and unloading. Another utensil holder in the form of a silverware basket 34 is located in the wash chamber 24. The silverware basket 34 can be mounted to the lower rack 32, and may be removably mounted. The silverware basket 34 can be positioned along a peripheral side of the lower rack 32. As illustrated, the silverware basket 34 is positioned along a peripheral side of the lower rack 32 that is parallel to the one of the side walls 20 of the wash tub 14. Optionally, the silverware basket 34 could be positioned along a peripheral side of the lower rack 32 that is parallel to the rear wall 22 or the door 28 when in the closed position. In yet another option, the silverware basket 34 could be positioned in the upper rack 30. In still another option, the silverware basket 34 could comprise a separate shallow rack positioned in the wash chamber 24.

Utensil holders 30, 32, 34 all hold various utensils for washing within the wash chamber. As used in this description, the term utensil is generic to dishes and the like that are washed in the dishwasher 10 and expressly includes, dishes, plates, bowls, silverware, glassware, stemware, pots, pans, and the like.

Figure 2:
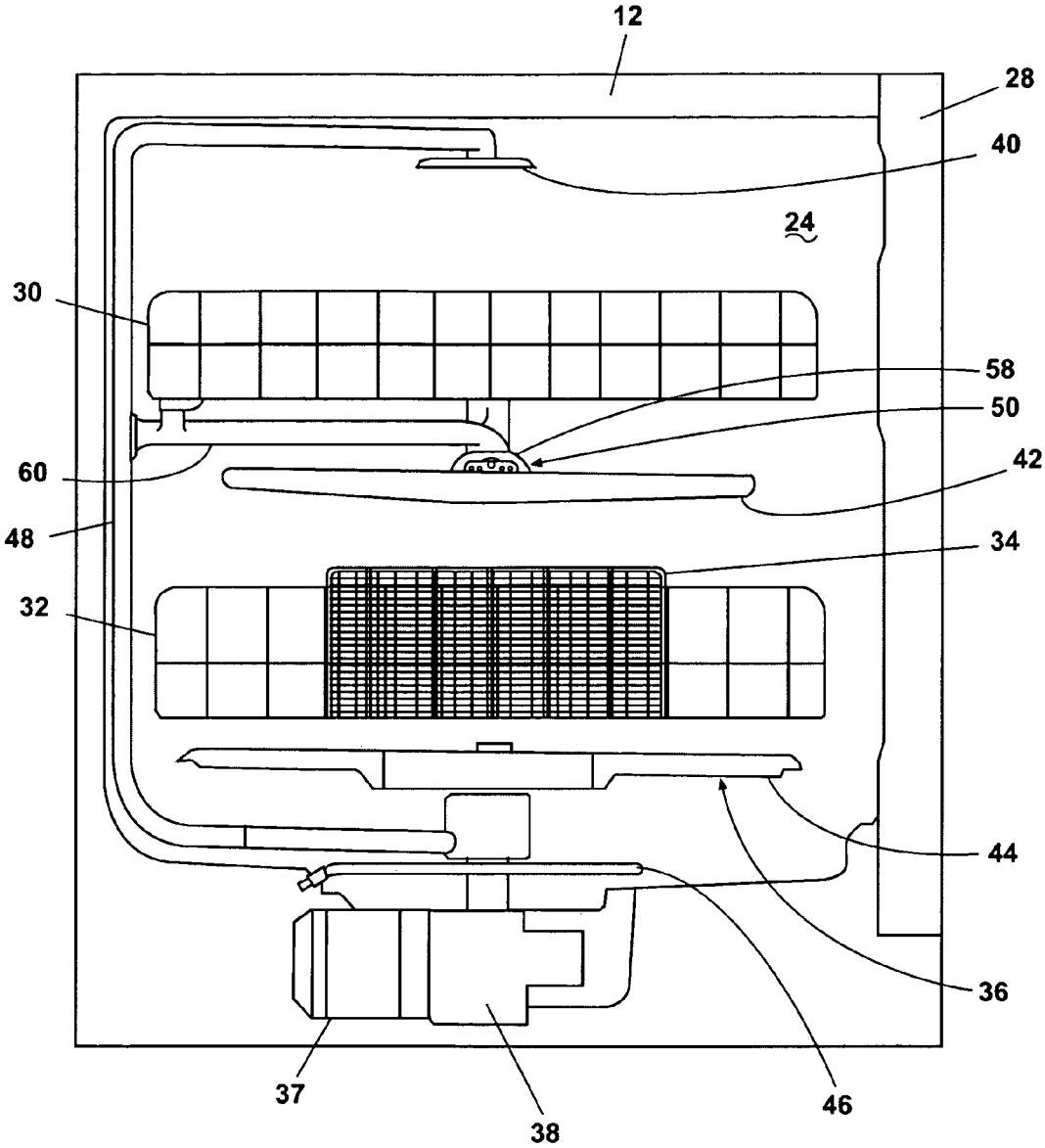
FIG. 2 is a schematic, side-sectional view of the dishwasher of FIG. 1.

FIG. 2 is a schematic, side-sectional view of the dishwasher of FIG. 1. The dishwasher 10 further includes a liquid circulation system 36 for introducing and circulating liquid and wash aids, such as detergents, rinse aids, and the like, throughout the wash chamber 24. The liquid circulation system 36 comprises a drain pump 37 and a recirculation pump 38 located in a lower portion or sump of the wash tub 14 and which pumps liquid to sprayers 40, 42, 44 and a sump heater 46 which acts to heat the washing fluid and is located in the lower portion of the dishwasher 10. The drain pump 37 pumps liquid to a household drain line (not shown). The recirculation pump 38 pumps liquid to sprayers 40, 42, 44. As illustrated, liquid is supplied to the sprayers 40 and 42 through a supply tube 48 that extends generally rearwardly from the recirculation pump 38 and upwardly along the rear wall 22 of the tub 14. While the supply tube 48 ultimately supplies liquid to the sprayers 40, 42, it may fluidly communicate with one or more manifold tubes that directly transport liquid to the sprayers 40, 42.

Sprayer 40 is located above the upper rack 30 and is illustrated as a fixed spray nozzle that sprays liquid downwardly within the wash chamber 24. Sprayers 42, 44 are located, respectively, beneath upper rack 30 and lower rack 32 and are illustrated as rotating spray arms. The upper spray arm 42 can be rotatably mounted to the bottom of the upper rack 30 and can provide a liquid spray upwardly through the bottom of the upper rack 30. The lower spray arm 44 can be rotatably mounted to the pump 38 beneath the lower rack 32 and can provide a liquid spray upwardly through the bottom of the lower rack 32. The upper spray arm 42 can optionally also provide a liquid spray downwardly onto the lower rack 32, but for purposes of simplification, this will not be illustrated herein.

In addition to the sprayers 40, 42, 44, all of which provide generalized sprays of liquid to the wash chamber 24, the dishwasher 10 includes an auxiliary sprayer 50 for providing one or more focused sprays of liquid to one or more discrete locations within the wash chamber 24.

Figure 3:
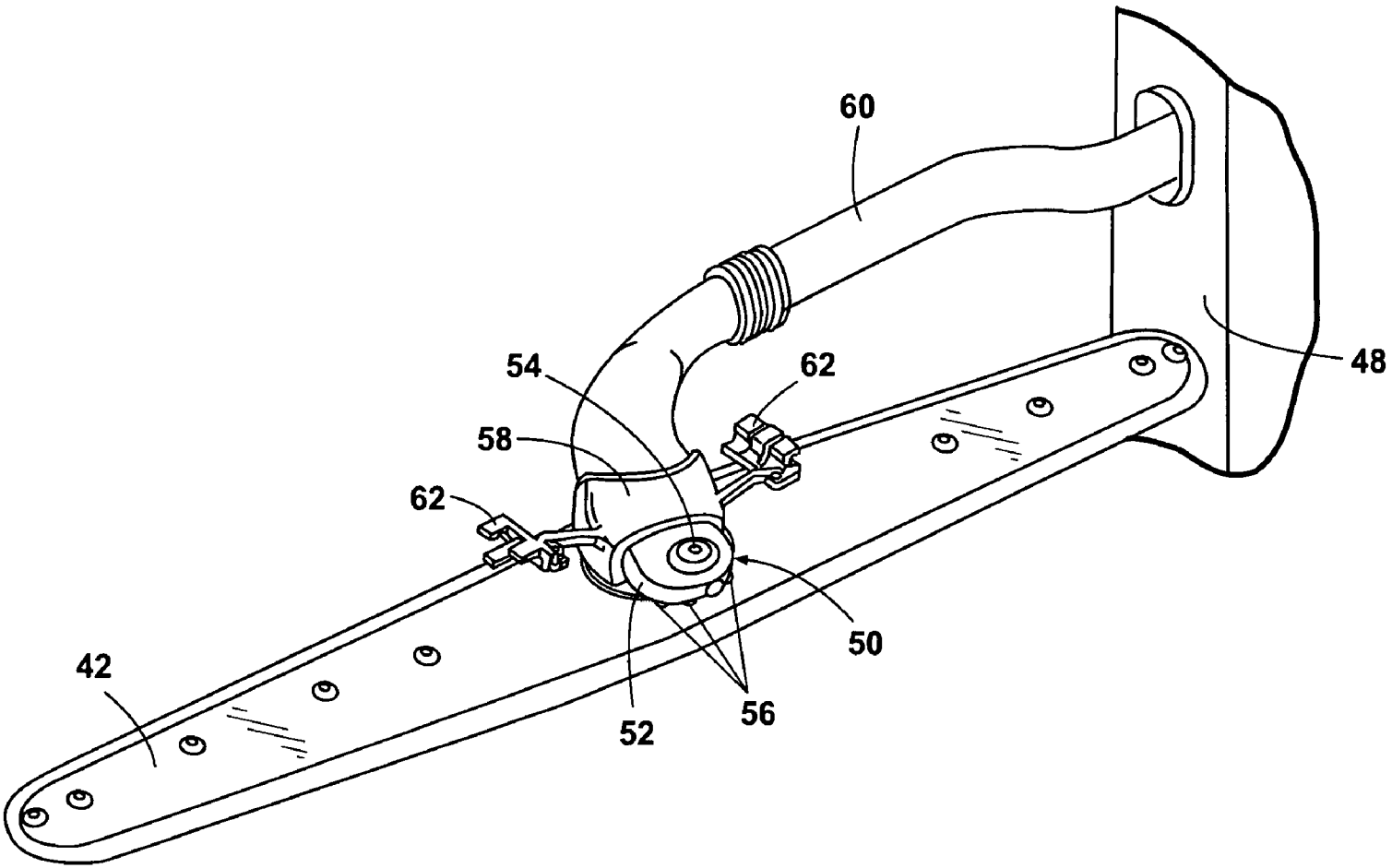
FIG. 3 is a top perspective view of the auxiliary sprayer of FIG. 1.

Referring to FIG. 3, the auxiliary sprayer 50 may comprise a fixed spray head 52 having one or more orifices 54, 56 for dispensing a stream of liquid forming a spray. The orifices 54, 56 can be configured to dispense one or more streams of wash liquid in different directions. As illustrated, the spray head has one upper orifice 54 for dispensing a stream of wash liquid in an upward direction and four lower orifices 56 for dispensing streams of wash liquid in a downward direction. The spray head 52 is mounted to a manifold hub 58 which is hollow and in fluid communication with the supply tube 48 via a manifold tube 60. The manifold tube 60 thus supplies liquid to both the upper spray arm 42 and the auxiliary sprayer 50. In the illustrated embodiment, liquid is simultaneously supplied to the upper spray arm 42 and the auxiliary sprayer 50 during operation of the dishwasher 10 so that liquid is sprayed concurrently by the upper spray arm 42 and the auxiliary sprayer 50. The rotation of the upper spray arm 42 may interfere with the spray of liquid from the auxiliary sprayer 50, especially for the downwardly directed stream of wash liquid from the lower orifices 56, thus potentially creating a pulsing or intermittent stream from the auxiliary sprayer 50.

The auxiliary sprayer 50 may be carried by the upper rack 30, above or below a bottom wall of the upper rack 30, or adjacent a peripheral side of the upper rack 30. As illustrated, the auxiliary sprayer 50 is coupled to the upper spray arm 42 and is positioned below the bottom wall of the upper rack 30. One or more brackets 62 or other suitable fixation means mounts the hub 58 to the upper rack 30 (FIG. 2), thus mounting both the upper spray arm 42 and the auxiliary sprayer 50 to the upper rack 30. Alternately, the auxiliary sprayer 50 may be mounted separately from the upper rack 30.

Figure 4A:
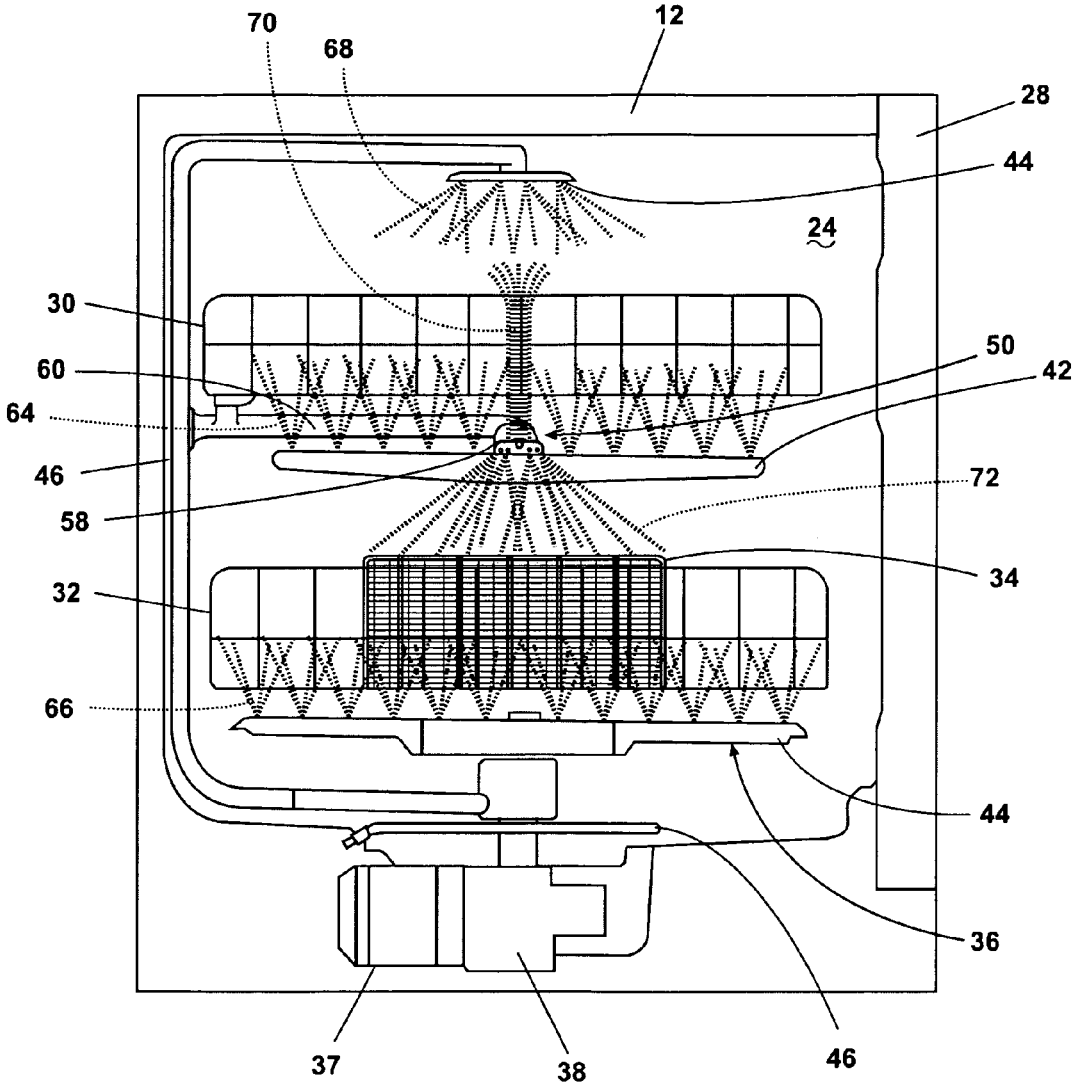
FIG. 4A is a schematic, side-sectional of the dishwasher of FIG. 1, illustrating several spray zones in the wash chamber.
Figure 4B:
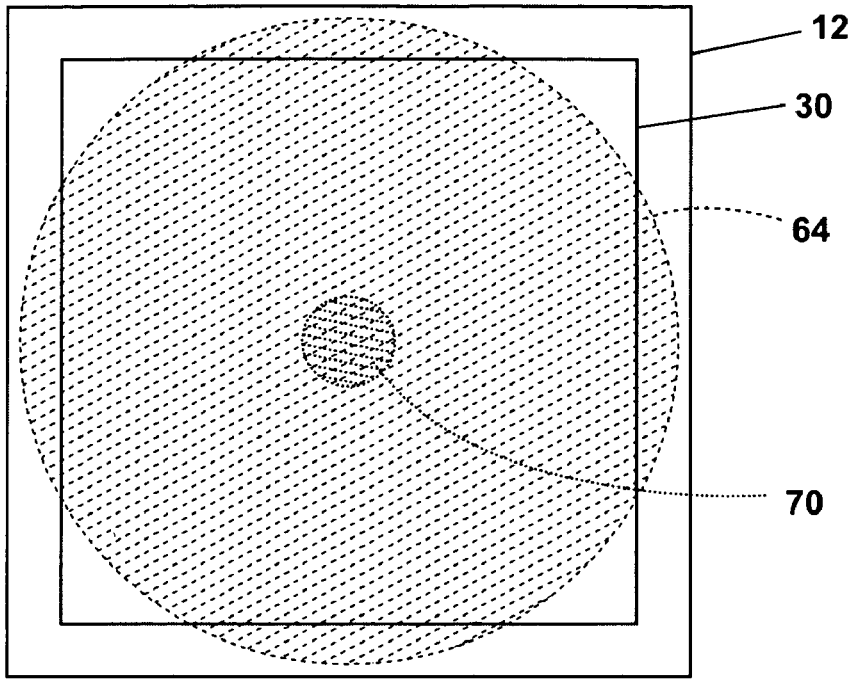
FIG. 4B is a schematic, sectional view through an upper rack of the dishwasher, illustrating the spray zones of the upper rack from FIG. 4A.
Figure 4C:
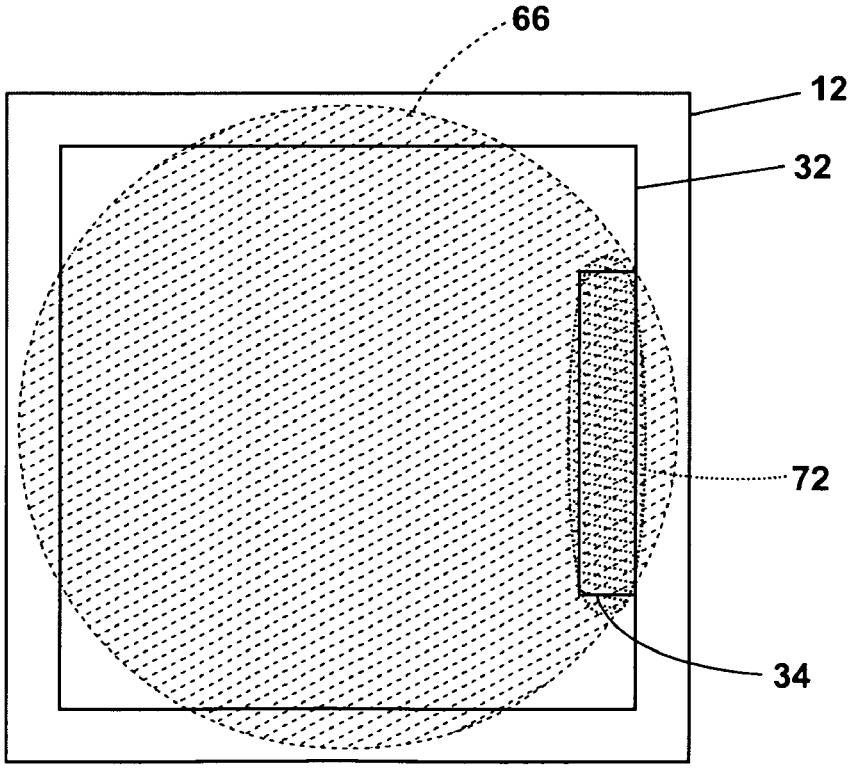
FIG. 4C is a schematic, sectional view through a lower rack and silverware basket of the dishwasher, illustrating the spray zones of the lower rack and silverware basket from FIG. 4A.

Referring to FIGS. 4A-4C, several spray zones in the wash chamber 24 are schematically illustrated. It is understood that the spray zones are not necessarily drawn to scale, and may be disproportionate to each other and to other features of the dishwasher 10. The upper spray arm 42 can provide a liquid spray upwardly through the bottom of the upper rack 30 to define a first generalized spray zone 64 for the entire upper rack 30. The lower spray arm 44 can provide a liquid spray upwardly through the bottom of the lower rack 32 to define a second generalized spray zone 66 for the entire lower rack 32. The fixed spray nozzle 40 can provide a downwardly-directed liquid spray to define a third generalized spray zone 68 for the wash chamber 24, particularly the upper rack 30.

The auxiliary sprayer 50 can provide an upwardly-directed liquid spray through the bottom of the upper rack 30 to define a localized spray zone 70 for a discrete portion of the upper rack 30. The upwardly-directed liquid spray is provided by the upper orifice 54 (FIG. 3). The localized spray zone 70 intersects with the first generalized spray zone 64 for a combined washing action in a discrete area of the upper rack 30, as indicated by the intersecting zones 64, 70 in FIG. 4B. The discrete area thus receives a more intense or concentrated wash than other areas of the upper rack 30. The intensified or concentrated wash may be attributable to one or both of the overlapping spray zones and the localized spray zone 70 can further have a greater pressure at the same elevation within the wash chamber 24 than the generalized wash zone 64.

The auxiliary sprayer 50 can further provide a downwardly-directed liquid spray toward the silverware basket 34 to define a silverware spray zone 72 for the silverware basket 34. The downwardly-directed liquid spray is provided by the lower orifices 56 (FIG. 3). The silverware spray zone 72 intersects with the second generalized spray zone 66 for a combined washing action in a discrete area encompassing the silverware basket 34, as indicated by the intersecting zones 66, 72 in FIG. 4C. The silverware basket 34 thus receives a more intense or concentrated wash than other areas of the lower rack 32.

The localized spray zone 70 can be designed to allow tall items such as glassware to receive the traditional wash provided by the upper spray arm 42 and the fixed spray nozzle 40, as well as an additional focused wash action from the auxiliary sprayer 50. Likewise, the silverware spray zone 72 can be designed to allow silverware to receive the traditional wash provided by the lower spray arm 44, as well as an additional focused wash action from the auxiliary sprayer 50. Thus, a dishwasher 10 having such a localized spray zone 70 and a silverware zone 72 may not only provide better washing performance for tall items and silverware, but may provide overall improved wash performance.

Figure 5:
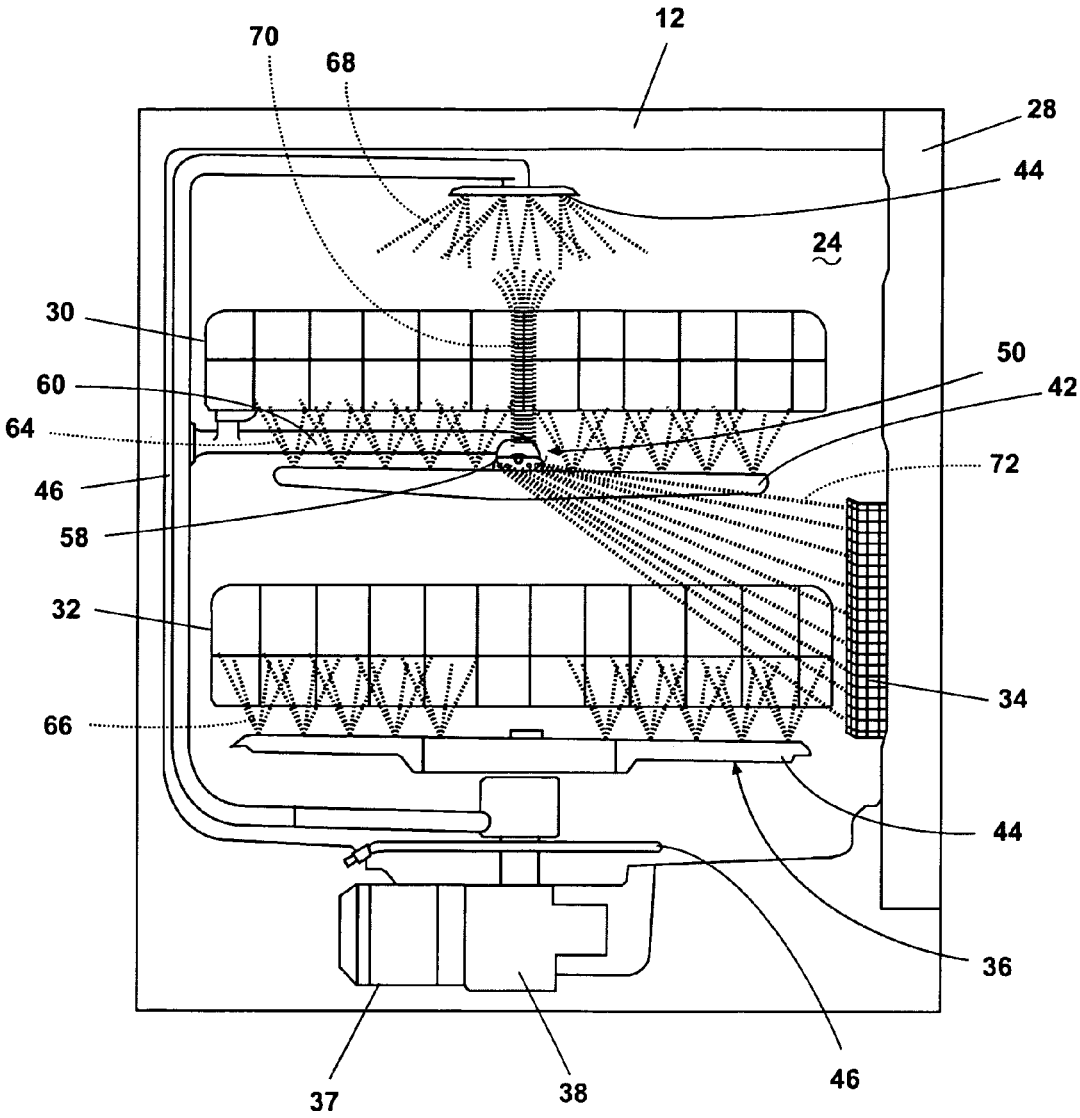
FIG. 5 is a schematic, side-sectional view of a second embodiment of an automatic dishwasher, illustrating a silverware basket on the door.

FIG. 5 is a schematic, side-sectional view of a second embodiment of an automatic dishwasher 10, in which like elements are identified using the same reference numerals. For the second embodiment of the dishwasher 10, the silverware basket 32 is located on the door 28. The silverware basket 32 can be removably mounted to the door 28. The localized spray zone 70 can be substantially identical to that of the first embodiment; however, the silverware spray zone 72 can be modified to account for the relocated silverware basket 32. Accordingly, the downwardly-directed liquid spray provided by the lower orifices 56 (FIG. 3) may be angled towards the door 28 to reach the silverware basket 32.

Figure 6:
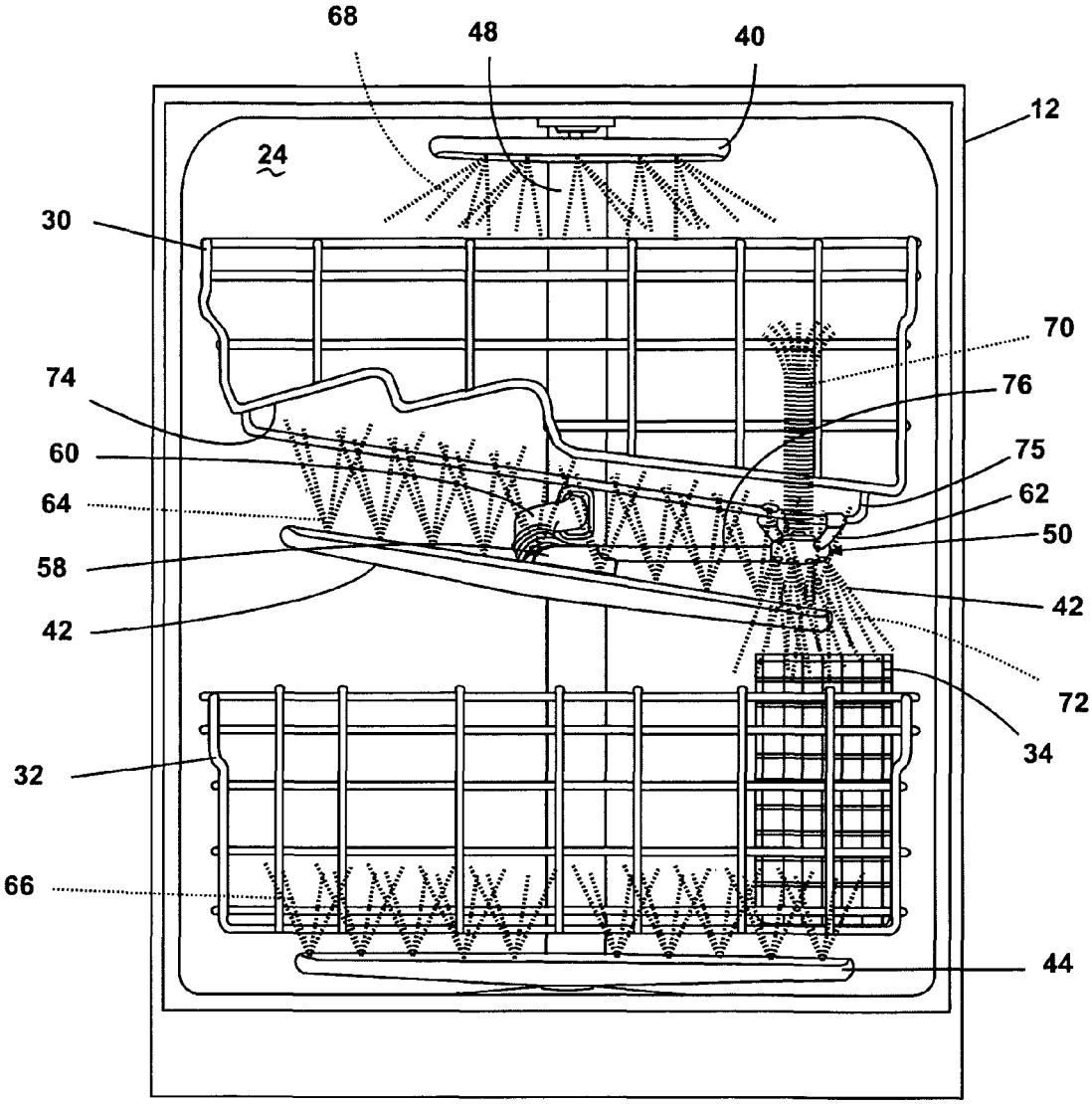
FIG. 6 is a schematic, front view of a third embodiment of an automatic dishwasher, illustrating a tiered upper rack.

FIG. 6 is a schematic, front view of a third embodiment of an automatic dishwasher 10, in which like elements are identified using the same reference numerals. For the third embodiment of the dishwasher 10, the upper rack 30 is tiered to accommodate utensils of varying heights. The upper rack 30 includes a generally angled lower wall 74 with a guard wire 75 depending therefrom. Furthermore, a modified auxiliary sprayer 50 is illustrated. Instead of being mounted to the hub 58, the auxiliary sprayer 50 is supported on a second manifold tube 76 that extends outwardly from the hub 58. The auxiliary sprayer 50 may be further supported by a bracket 62 or other suitable fixation means attached to the guard wire 75, although it could alternately be attached to the lower wall 74. The manifold tube 60 still supplies both the upper spray arm 42 and the auxiliary sprayer 50 with liquid via the manifold hub 58, but the liquid must further travel through the second manifold tube 76 to reach the auxiliary sprayer 50.

Figure 7:
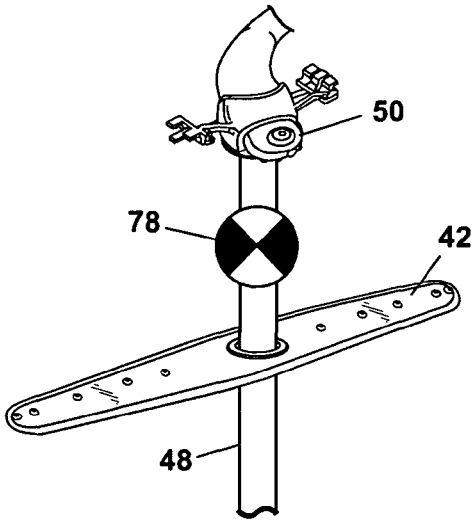
FIG. 7 is a schematic illustration of a fourth embodiment of the invention, illustrating a selective operation for the auxiliary sprayer 50.

FIG. 7 is a schematic illustration of a fourth embodiment of the invention, illustrating a selective operation for the auxiliary sprayer 50. For the fourth embodiment, a valve 78 is positioned between the upper spray arm 42 and the auxiliary sprayer 50 so the liquid is selectively supplied to the auxiliary sprayer 50 during operation of the dishwasher 10. The valve 78 controls whether liquid is being sprayed by the auxiliary sprayer 50. Thus, when the valve is closed, liquid will not be sprayed by the auxiliary sprayer 50. When the valve 78 is open, liquid can be sprayed concurrently by the upper spray arm 42 and the auxiliary sprayer 50. The valve 78 can alternately be configured to divert only a portion of liquid from the upper spray arm 42 to the auxiliary sprayer 50.

The opening and closing of the valve 78 can be automatically controlled in accordance with an operational or wash cycle of the dishwasher 10, or can be controlled by the user who may elect when the localized spray zone 70 and the silverware spray zone 72 are needed for additional focused wash action to discrete areas of the dishwasher 10. While not illustrated herein, an additional valve can be utilized for the auxiliary sprayer 50 to control liquid flow to one or both of the orifices 54, 56, so that one or both of the localized spray zone 70 and the silverware spray zone 72 are operating.

Figure 8:
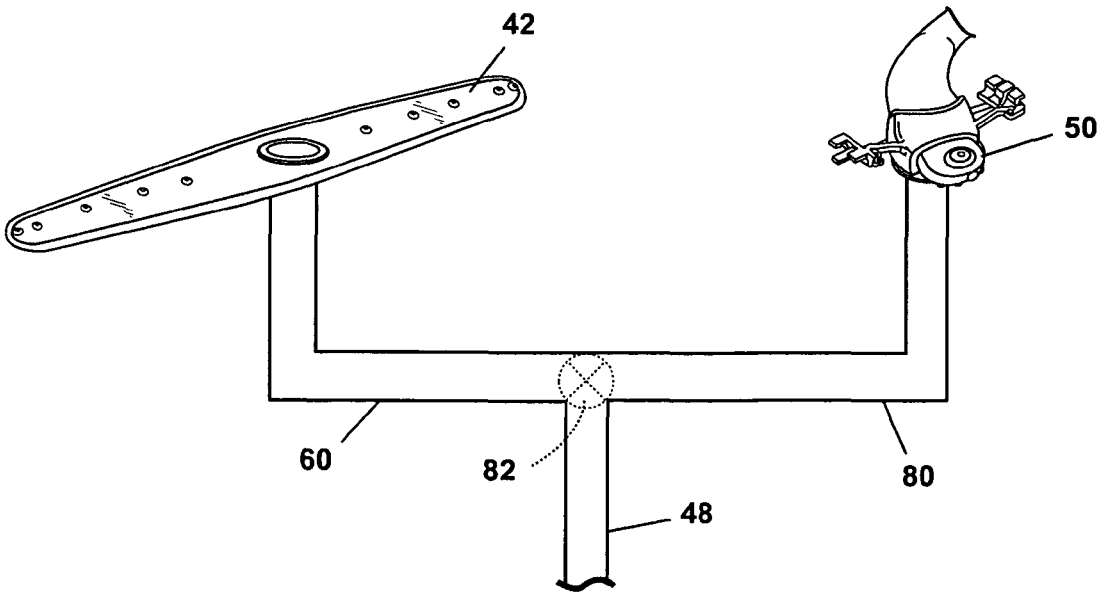
FIG. 8 is a schematic illustration of a fifth embodiment of the invention, illustrating an alternate liquid supply arrangement for the auxiliary sprayer.

FIG. 8 is a schematic illustration of a fifth embodiment of the invention, illustrating an alternate liquid supply arrangement for the auxiliary sprayer 50. For the fifth embodiment, a separate manifold tube 80 is in fluid communication with the supply tube 48 to supply liquid to the auxiliary sprayer 50, while the upper spray arm 42 is supplied with liquid through the manifold 60, like the first embodiment. Liquid can be simultaneously supplied to both manifold tubes 60, 80 during operation of the dishwasher 10 so that liquid is sprayed concurrently by the upper spray arm 42 and the auxiliary sprayer 50. Alternately, an optional valve 82 can control whether liquid is delivered to the manifold tube 60 supplying the upper spray arm 42 or the manifold tube 80 supplying the auxiliary sprayer 50.

While the invention has been specifically described in connection with certain specific embodiments thereof, it is to be understood that this is by way of illustration and not of limitation. For example, the auxiliary sprayer 50 of the invention can be applied to any rack within a dishwasher, and it is not limited to the upper rack 30. For example, in a dishwasher having three racks, the auxiliary sprayer 50 could be mounted to the middle rack or the topmost rack. Reasonable variation and modification are possible within the scope of the forgoing disclosure and drawings without departing from the spirit of the invention which is defined in the appended claims.

What is claimed is:

1. An automatic dishwasher comprising:

a tub defining a wash chamber with an open face;

a door for selectively closing the open face;

an upper rack having a bottom located within the wash chamber;

a silverware basket located in the wash chamber beneath the upper rack;

an upper spray arm rotatably mounted to the bottom of the upper rack and providing a liquid spray upwardly through the bottom of the upper rack to define a generalized spray zone for the entire upper rack; and an auxiliary sprayer carried by the upper rack and having a localized spray zone directed upwardly to a discrete portion of the upper rack and a silverware spray zone directed downwardly onto the silverware basket.

2. The automatic dishwasher according to claim 1 and further comprising a lower rack located beneath the upper rack within the wash chamber.

3. The automatic dishwasher according to claim 2, wherein the silverware basket is located in the lower rack.

4. The automatic dishwasher according to claim 2 and further comprising a lower spray arm rotatably mounted beneath the lower rack and providing a liquid spray upwardly through the bottom of the lower rack to define a generalized spray zone for the lower rack.

5. The automatic dishwasher according to claim 1, wherein the silverware basket is located in the door.

6. The automatic dishwasher according to claim 1, wherein the silverware basket is located along a side of the wash chamber.

7. The automatic dishwasher according to claim 1, wherein the silverware spray zone is directed toward the door.

8. The automatic dishwasher according to claim 1, wherein the silverware spray zone is directed along a side of the wash chamber.

9. The automatic dishwasher according to claim 1 and further comprising a liquid circulation system for supplying liquid to the upper spray arm and the auxiliary sprayer.

10. The automatic dishwasher according to claim 9 wherein the liquid circulation system includes a single manifold tube supplying liquid to the upper spray arm and the auxiliary sprayer.

11. The automatic dishwasher according to claim 9 wherein the liquid circulation system includes a first manifold tube supplying liquid to the upper spray arm and a second manifold tube supplying liquid to the auxiliary sprayer.

12. The automatic dishwasher according to claim 9 wherein the liquid circulation system includes a valve for selectively controlling the supply of liquid to the auxiliary sprayer.

13. The automatic dishwasher according to claim 12 wherein the valve is positioned between the upper spray arm and the auxiliary sprayer.

14. The automatic dishwasher according to claim 1, wherein the auxiliary sprayer comprises a fixed spray head having at least one first orifice producing the localized spray zone and at least one second orifice producing the silverware spray zone.

15. The automatic dishwasher according to claim 1, wherein the localized spray zone intersects with the generalized spray zone.

16. The automatic dishwasher according to claim 1, wherein the localized spray zone has a greater pressure at the same elevation within the wash chamber as the generalized spray zone.

* * * * *